US005816124A

United States Patent [19]

Madrzak

[11] Patent Number: 5,816,124

[45] Date of Patent: Oct. 6, 1998

[54] METHOD AND DEVICE FOR TRANSVERSE SEPARATION OF A RUNNING MATERIAL WEB

[75] Inventor: Zygmunt Madrzak, Heidenheim, Germany

[73] Assignee: Voith Sulzer Papiermaschinen GmbH, Heidenheim, Germany

[21] Appl. No.: 795,448

[22] Filed: Feb. 4, 1997

Related U.S. Application Data

[63] Continuation of Ser. No. 516,744, Aug. 18, 1995, abandoned.

[30] Foreign Application Priority Data

Aug. 22, 1994 [DE] Germany ..... 9413363 U

[51] Int. Cl.[6] ..... B26D 1/00

[52] U.S. Cl. ..... 83/13; 83/42; 83/327; 83/610

[58] Field of Search ..... 83/327, 660, 13, 83/42, 64, 597, 601, 610; 225/100, 104

[56] References Cited

U.S. PATENT DOCUMENTS

| | | | |
|---|---|---|---|
| 2,080,052 | 5/1937 | Lemaster | 83/597 |
| 2,588,809 | 3/1952 | Demarest | 83/610 |
| 2,796,125 | 6/1957 | Munchbach | 83/327 |
| 3,147,658 | 9/1964 | Boyd | 83/660 X |
| 3,545,327 | 12/1970 | Dorman | 83/610 X |
| 3,710,664 | 1/1973 | Eveland | 83/610 X |
| 3,739,965 | 6/1973 | Jespersen et al. | 83/660 X |
| 3,977,280 | 8/1976 | Mundt et al. | 83/42 |
| 4,114,491 | 9/1978 | Hashimoto et al. | 83/694 X |
| 4,404,880 | 9/1983 | DeLuca | 83/42 |
| 4,493,236 | 1/1985 | Toth | 83/673 X |
| 4,697,726 | 10/1987 | Gaucher | 225/100 |
| 5,279,195 | 1/1994 | Breton | 83/610 X |

*Primary Examiner*—Maurina T. Rachuba

*Attorney, Agent, or Firm*—Marshall, O'Toole, Gerstein, Murray & Borun

[57] ABSTRACT

A device and method for separating a running material web includes a knife, having a substantially planar body and a toothed edge, and an apparatus for swinging the knife into the running material web. The method includes running the material web in a direction and subsequently swinging the knife toward the web in a direction, the cutting edge contacting the web at an angle of inclination between the knife body and the web measuring at most 45°.

12 Claims, 4 Drawing Sheets

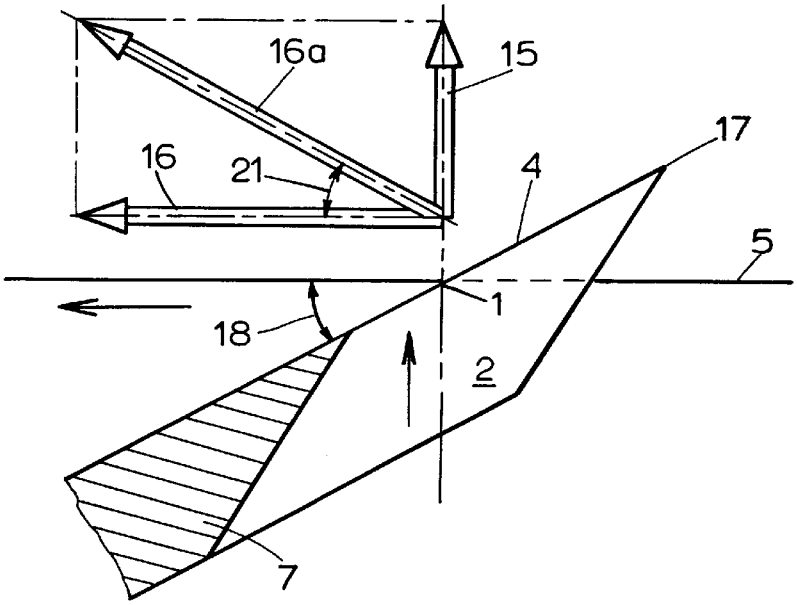
Fig. 3
Fig. 4
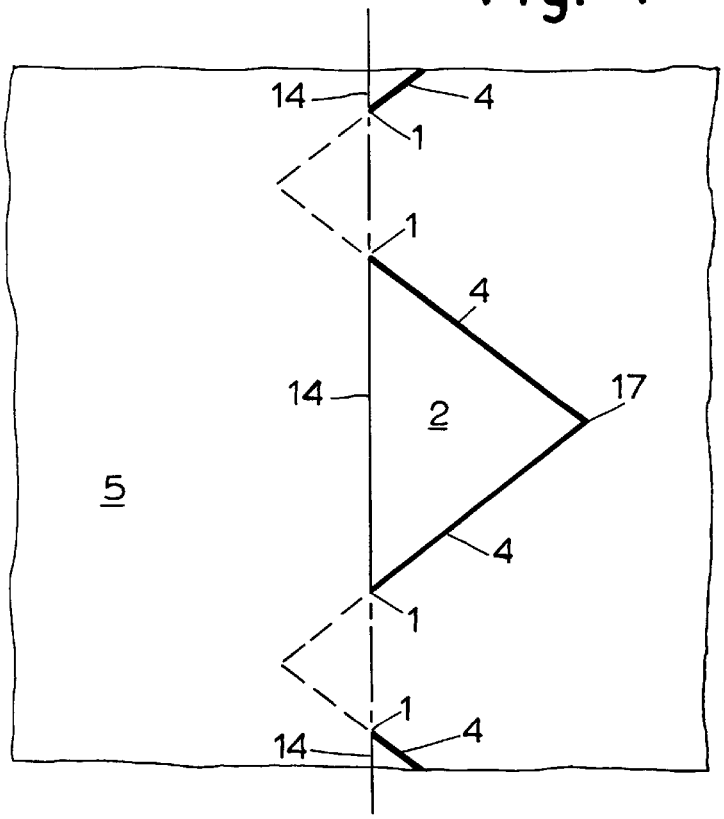

METHOD AND DEVICE FOR TRANSVERSE SEPARATION OF A RUNNING MATERIAL WEB

This is a continuation of U.S. application Ser. No. 08/516,744, filed Aug. 18, 1995, now abandoned.

BACKGROUND OF THE INVENTION

1. Field of the Invention

The invention relates to devices and methods for the transverse separation of material webs, particularly paper webs.

2. Description of Related Technology

The invention is concerned with a method as well as with a device for the transverse separation (i.e., cutting) of material webs. Such methods and devices are used, for example, in paper machines and, furthermore, in machines which are connected downstream of the paper machine, for example, in rewinders, coating machines, and reel cutters.

The known devices have a knife that is as wide as the machine and extends transversely with respect to the movement of the paper through the paper machine.

In the machines known in the art, the teeth of the knife cause "indentations" at the cutting edge of the web. These indentations are separated the same distance as the distance between the teeth of the knife.

During the separation process, it is advantageous to achieve a cut edge which is as shred-free as possible across the width of the material web.

Moreover, low indentation depth of the residual flap running into the coating machine is very important. If the paper indentations are too long and are partly cut or remain hanging, they cause doctor stripes or moist stripes in the case of LWC paper, for example, under the coating blade of the coating machine, and most of the time these stripes lead to tears.

Thus far, attempts have been made to shorten the indentations on the cutting edge of the material web: the tooth geometry of the knife has been varied and the rate at which the knife is introduced to the material web has been increased. Although the indentations can be made somewhat smaller, they cannot be avoided, especially at high web velocities. Indentations still represent a great problem.

SUMMARY OF THE INVENTION

It is an object of the invention to overcome one or more of the problems described above. It is also an object of the invention to reduce or completely avoid the indentations that occur at the cut edge of a material web during the separation of the web.

According to the invention a device and method for the separation of a running material web utilizes a toothed knife. The knife is swung into the material web at a very sharp angle of inclination with respect to the web. This angle of inclination is at most 45°.

Other objects and advantages of the invention will be apparent to those skilled in the art from the following detailed description taken in conjunction with the drawings and the appended claims.

BRIEF DESCRIPTION OF THE DRAWINGS

FIG. 3 is an enlarged and partially schematic side view of the device of FIG. 2.

FIG. 4 is an enlarged view of a cut material web showing cutting indentations from a separating device according to the invention.

DETAILED DESCRIPTION OF THE INVENTION

Figure 1:
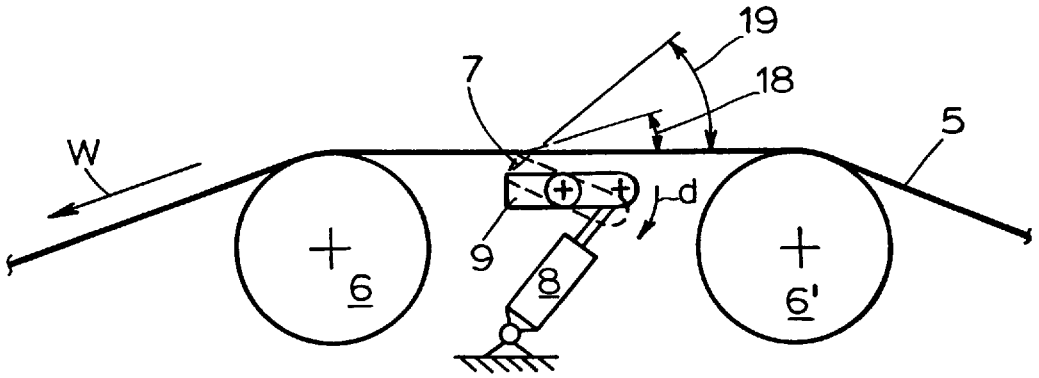
FIG. 1 is a partially schematic side view of a separating device according to the invention.

According to the invention, a separation device has a knife that is inclined extremely sharply against a material web with respect to a direction of movement of the web.

As a result of the extreme inclination of the knife to the material web, indentations on the cut edge of the separated web are greatly shortened and at best, disappear completely. The cut edge becomes a straight line. This result can be explained by the following four physical effects:

1. As a result of the extreme inclination of the knife, cutting time is shortened because to achieve complete separation of the paper web, it is not the height of the cutting teeth, but essentially the distance between the foot of the cutting teeth and the material web that must be reduced.

2. As a result of the extreme inclination of the knife, the indentations on the material web become shorter since the active cutting point migrates with the running web along the cutting tooth flank.

3. As a result of the extreme inclination of the knife, cutting time and indentation depth of the web are reduced, since, after the web is pierced by the first tooth tips, it attempts to "climb up" on the teeth of the knife. This leads to a slight movement of the web in the direction of the tooth feet, as a result of which the separation process is shortened. Thus, the web no longer has the tendency to avoid [evade] the knife. As a result, the tendency of the web to form folds is avoided.

4. With a device according to the invention, the separation of the web is accomplished by cutting and not by tearing (as occurs with prior art separation devices). This is especially advantageous for the subsequent processing of the web.

In order to provide for easier handling of a machine-wide knife according to the invention, the device may include a knife having several separations at points along the width of the machine, resulting in several partial knife pieces. The partial pieces of the knife are lighter and shorter than traditional machine-wide knives and therefore are preferable for purposes of assembly or replacement.

A knife according to the invention is introduced to the material web via an activating element, which can operate, for example, pneumatically, hydraulically, electrically, piezoelectrically, magnetostrictively, magnetically or inductively. The force and the path (that is, the speed) of the knife can be adapted to meet desired requirements by using a suitable transmission (with a lever or another transmission). The movement of the knife can be in the form of a translation, a rotation or a combined movement thereof. A rotary inducing movement with the aid of a pneumatic cylinder with lever transmission is preferable.

A method and the device according to the invention make it possible to reduce the depth of the indentations on the web to zero in the ideal case. In such a case, the cut edge corresponds to a straight line along the entire width of the web which extends perpendicular to the direction of movement of the web.

As discussed herein, a decisive measure according to the invention consists in having an extremely sharp angle of inclination between the knife and the web. Accordingly, the angle should be less than 45° and the indentations of the knife should be oriented opposite to the direction of movement of the web.

Moreover, it has been found that there are two further parameters that have a certain influence on the indentation of the web: first, the speed of the material web and, second, the velocity with which the knife is placed into its working position. These three parameters: the angle between the material web and the knife, the velocity of the material web, and the velocity with which the knife is swung toward the web; can be adapted to one another in such a way that the cut edge of the material web will be approximately a straight line. Furthermore, it has been found the these three parameters are related to each other through the following equation:

$$\tan \alpha = V_{knife}/V_{web}$$

where:

$\alpha$=the angle of inclination between knife and web;

$V_{knife}$=the velocity of movement of the knife perpendicularly to the web; and $V_{web}$=the web velocity.

Figure 2:
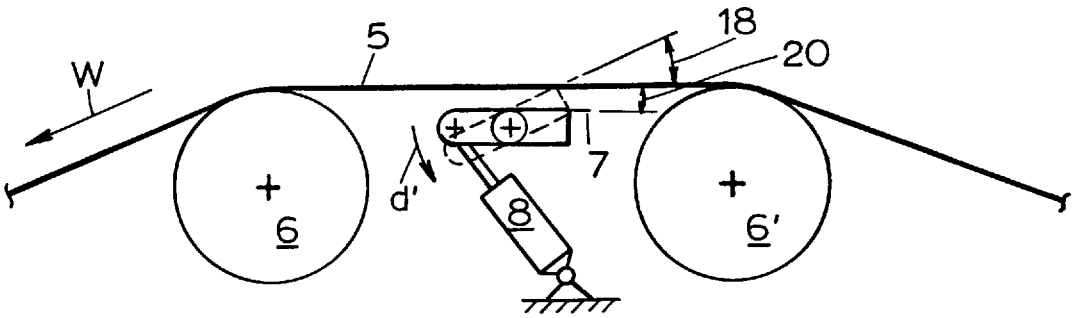
FIG. 2 is a partially schematic side view of a second embodiment of a separating device according to the invention.

With respect to the drawings, FIGS. 1 and 2 each show a separating device according to the invention. FIG. 1 shows a "counterdirectional" cutting process. Here, the teeth of a knife 7 are directed against the web. In other words, the direction of movement of the knife 7 as it is swung (i.e. rotated) toward the web (see arrow d) is opposite or counter to a direction of movement w of a material web 5 being cut by the knife 7. Based on the kinematics of the device, at the moment of separation of the web 5, an immersion angle $\alpha$ (shown as angle 18 in FIG. 1) is formed between the knife 7 and the web 5. This angle is, for example, 20°. Even in the rest position, the knife 7 forms an angle 19 with the web 5, this angle being substantially smaller than 90°.

FIG. 2 shows a separation device according to the invention which is similar to the device shown in FIG. 1. However, this device carries out a swinging or rotational "codirectional" cutting process. Here, the knife 7 is not directed opposite to the web 5, but it is swung or rotated in a direction d' and thus generally moves in the same direction as the web 5 (moving in the direction w) during the cutting process.

Besides the knife 7, both the device shown in FIG. 1 and the device shown in FIG. 2 have means for swinging the knife 7, shown as an activating element 8 which engages with a double lever 9. Furthermore, the device includes means for adjusting the velocity of the knife 7 shown in the figures by the activating element 8. The knife 7 is secured at one of the free ends of the double lever 9.

FIGS. 3 and 4 show a mode of operation of an extremely inclined knife according to the invention. FIG. 3 shows the web 5 in a side view in a very schematic representation. The vector diagram in FIG. 3 shows a vector 15 of the relative velocity of the knife 7 with respect to the material web 5. It further shows a vector 16 of the relative velocity of the web to an optionally present velocity component of the knife. Vectorial addition of these two quantities gives a resultant vector 16*a* which forms an angle 21 with the vector 16. Under ideal conditions, the cut edge is adjusted so that the cutting angle 18 corresponds to the angle 21 between the vectors 16*a* and 16. In such a case, an ideal cutting line 14 is obtained as shown in FIG. 4. It can be seen from FIG. 4 how the partial sections of the individual tooth flanks 4 run together to a totally straight cutting line 14.

FIGS. 3 and 4 illustrate the ideal case of the cutting geometry. If, during penetration of the material web by a tooth tip 17, the material web "climbs onto" the tooth tip 17, then the movement processes are somewhat different. As previously noted, the speed of the material web, and the velocity with which the knife is placed into its working position influence the indentation of the web. The speed of the material web is controlled by means for adjusting the velocity of the material web that include one or more rolls 6, 6'.

Figure 5:
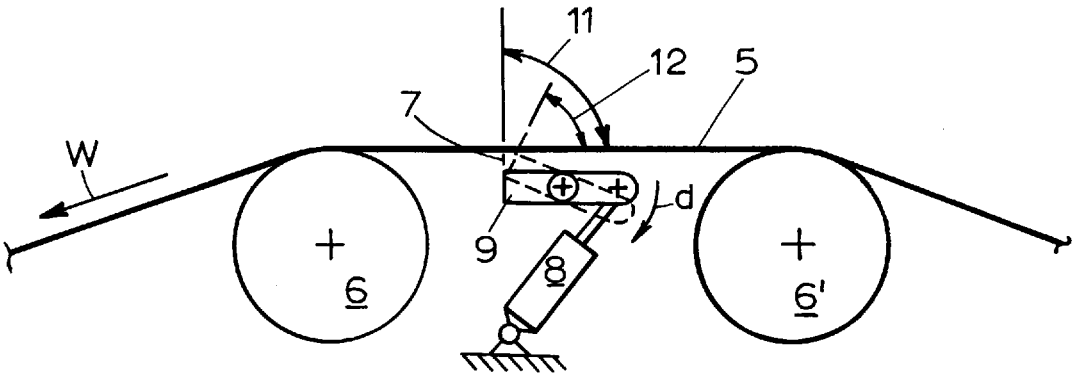
Fig. 5 PRIOR ART
FIG. 5 is a side view of a separating device according to the prior art.
Figure 6:
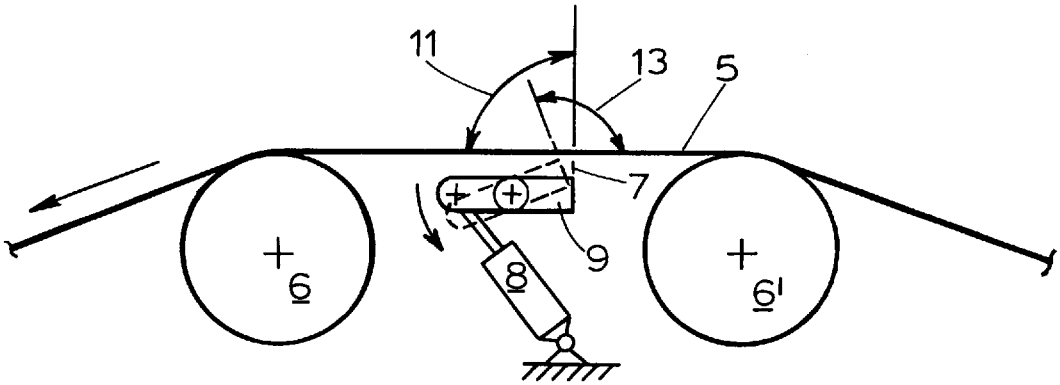
Fig. 6 PRIOR ART
FIG. 6 is a side view of a second embodiment of a separating device according to the prior art.

FIGS. 5 and 6 show separating devices according to the state of the art. In the device according to FIG. 5, the knife 7 operates "counterdirectional" to the material web. The rest position of the knife forms an angle 11 of about 90° with the material web. Although during the cutting process this angle is smaller than 90°, it is by far not as small as an angle of inclination formed between a web and a device according to the invention.

In the device according to FIG. 6, an angle 11 is again about 90°. Due to the "codirectional" movements of the material web 5 and the knife 7, the immersion angle 13 of the knife 7 during the cutting process is greater than 90°.

Figure 7:
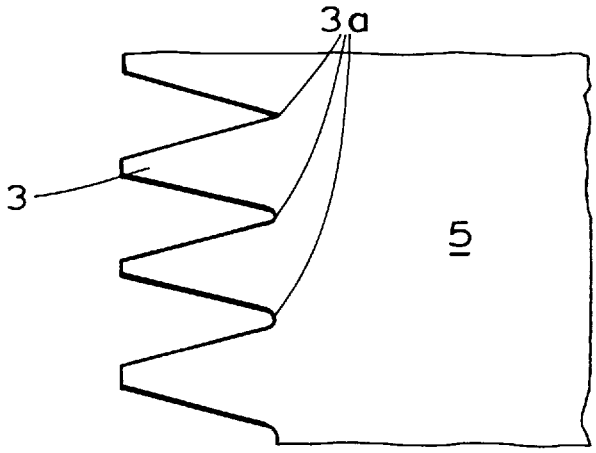
FIG. 7 is a top view of a material web cut by a separating device according to FIGS. 5 or 6.

The devices according to FIGS. 5 and 6 according to the state of the art provide an indented cut edge 3 as shown in FIG. 7. The indented cut edge 3 is very unfavorable for further processing.

Figure 8:
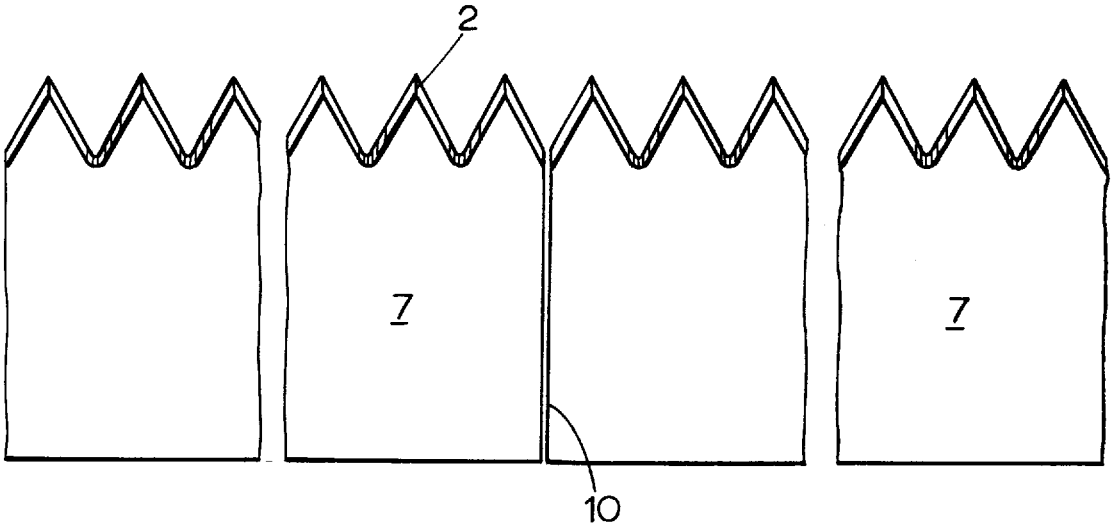
FIG. 8 is a top plan view of a knife according to the invention.

FIG. 8 shows a knife 7 according to the invention. Indentations 2 of this knife are designed as in the known commercial knives. However, the fact that the knife 7 is made up of individual segments is new. The commissures 10 between the individual knives are placed expediently at the feet of the teeth, as shown in FIG. 8.

The following is an identification of the reference numbers used in the drawings:

1 Active cutting point
2 Tooth
3 Indented cut edge
4 Tooth flank
5 Material web
6 Roll
6' Roll
7 Knife
8 Activating element
9 Lever
10 Separation point
11 Angle: rest position of the knife in construction of the prior art
12 Angle: cutting angle of the prior art (counterdirectional)
13 Angle: cutting angle of the prior art (codirectional)
14 Cutting line
15 Velocity vector perpendicular to the web
16 Velocity vector parallel to the web
17 Tooth tip
18 Angle: adjusted cutting angle of the new construction
19 Angle: rest position of the new construction (counterdirectional)

20 Angle: rest position of the new construction (codirectional)

21 Angle: angle between vectors 15 and 16

The foregoing detailed description is given for clearness of understanding only, and no unnecessary limitations should be understood therefrom, as modifications within the scope of the invention will be apparent to those skilled in the art.

I claim:

1. A method of separating a running material web with a knife, the knife comprising a substantially planar body and a cutting edge having teeth, the cutting edge disposed at a side of the knife body, said method comprising:

(a) running the material web in a direction; and (b) subsequently swinging the knife edge into contact with the running material web at an angle of inclination between the knife body and the web of at most 45°, the knife being oriented with respect to the web such that a knife direction defined by a line beginning at the knife body and extending to the cutting edge is opposed to the direction of running of the running material web.

2. The method of claim 1 wherein the knife is swung into the material web in a direction opposite to the direction of running of the running material web.

3. The method of claim 1 wherein the knife is swung into the material web in the direction of running of the running material web.

4. The method of claim 1 further comprising a step of adjusting the angle of inclination, a velocity of the running web, and a speed of movement of the knife to result in a substantially straight cutting edge of the material web.

5. The method of claim 1 wherein the angle $\alpha$ of inclination between the knife and the material web, a relative velocity $V_{knife}$ of the knife to the material web and a relative velocity $V_{web}$ of the material web to a velocity component of the knife parallel to the web are defined by the following equation:

$$\tan \alpha = V_{knife}/V_{web}.$$

6. A device for separating a running material web with a knife, said device comprising:

(a) a knife comprising a substantially planar body and a cutting edge having teeth, the cutting edge disposed at a side of the knife body; and (b) means connected to the knife for swinging the knife toward the running material web such that the cutting edge contacts the running material web at an angle of inclination between the knife body and the running material web of at most 45°, and such that the knife is oriented with respect to the web such that a knife direction defined by a line beginning at the knife body and extending to the cutting edge is opposed to the direction of running of the running material web.

7. The device of claim 6 wherein said means orients the knife at an angle of inclination between the knife body and the running material web of between about 10° and about 40° during the separation of the running material web.

8. The device of claim 6 further comprising means for adjusting the velocity of the running material web and means for adjusting an immersion velocity of the knife, wherein the means for swinging the knife, the means for adjusting the web velocity, and the means for adjusting the immersion velocity of the knife are all adjusted to produce an approximately straight cut edge of the material web.

9. The device of claim 6 wherein the means for swinging moves the knife in a direction opposite to the direction of running of the running material web.

10. The device of claim 6 wherein the means for swinging moves the knife in the direction of running of the running material web.

11. The device of claim 6 wherein the knife has a width extending partially along a width of the running material web.

12. A method of separating a continuously moving material web with a knife, the knife comprising a substantially planar body and a cutting edge having teeth, said method comprising:

(a) continuously moving the material web in a direction; and (b) subsequently swinging the knife toward the continuously moving material web such that the cutting edge contacts the web at an angle of inclination between the knife body and the web of at most 45°.

* * * * *